United States Patent [19]

Alter

[11] 3,983,363

[45] Sept. 28, 1976

[54] ELECTRICALLY HEATED SEMEN WARMING AND STORAGE UNIT

[76] Inventor: Raymond R. Alter, Rte. 1, Darien, Wis. 53114

[22] Filed: Feb. 3, 1975

[21] Appl. No.: 546,349

[52] U.S. Cl. ..... 219/521; 128/235; 219/242; 219/386; 219/415; 219/421

[51] Int. Cl.[2] ..... H05B 3/06; F24C 7/10; A61D 7/02

[58] Field of Search ..... 219/521, 428–442, 219/385–387, 280, 200, 201, 415–419, 421, 242; 119/1; 128/235

[56] References Cited

UNITED STATES PATENTS

| | | | |
|---|---|---|---|
| 1,367,952 | 2/1921 | Emerson | 219/521 |
| 1,917,305 | 7/1933 | Johnson | 219/242 |
| 2,299,401 | 10/1942 | Melton | 219/428 |
| 2,487,161 | 11/1949 | Melton | 219/521 |
| 2,562,821 | 7/1951 | Rothweiler | 219/521 |
| 2,907,861 | 10/1959 | Melton | 219/521 |
| 2,932,718 | 4/1960 | Marsters | 219/521 |
| 3,169,078 | 2/1965 | Baker et al. | 219/421 X |
| 3,764,780 | 10/1973 | Ellis | 219/521 X |
| 3,805,784 | 4/1974 | Alter | 128/235 |
| 3,877,430 | 4/1975 | Wieder | 128/235 |

FOREIGN PATENTS OR APPLICATIONS

| | | | |
|---|---|---|---|
| 1,472,139 | 1/1967 | France | 128/235 |
| 738,336 | 10/1932 | France | 219/242 |
| 1,051,578 | 12/1966 | United Kingdom | 219/242 |

*Primary Examiner*—A. Bartis
*Attorney, Agent, or Firm*—Johnson, Dienner, Emrich & Wagner

[57] ABSTRACT

A warming and storage unit for quickly thawing frozen artificial insemination materials and in which such materials and insemination guns used in such operations may be stored at desirable temperatures while awaiting use. The unit includes a metal block provided with a thermostatically controlled electric heater means. The block has an elongated vertically extending central well for receiving semen capsules for thawing and a horizontally extending compartment spaced from the well and being of such size as to accommodate and store at least one artificial insemination gun. The metal block is enclosed in a heat insulating housing provided with openings for access to the well and compartment.

4 Claims, 7 Drawing Figures

ELECTRICALLY HEATED SEMEN WARMING AND STORAGE UNIT

BACKGROUND OF THE INVENTION

This invention relates to warming and storage units, and, more particularly, to warming and storage units which are particularly well adapted for thawing artificial insemination materials for use, and in which such materials and the devices used in such operations may be stored at desirable temperatures while awaiting use in such operations.

It is a primary object of the present invention to afford a novel warming and storage unit.

Another object of the present invention is to afford a novel warming and storage unit which is particularly well adapted for the thawing and warming of artificial insemination materials, and for the storage, at desirable warm temperatures, of such thawed materials and the devices used in administering the same.

Semen, used in artificial insemination operations, is commonly packaged in capsules in the form of plastic straws or glass ampules, or the like, and stored in frozen condition in a suitable refrigerant, such as liquid nitrogen, or the like, at what may be considered to be extremely low temperatures, such as, for example, several hundred degrees below zero Fahrenheit. Normally, prior to using such capsules of semen in an insemination operation, the semen therein is thawed. Preferably, in the interest of minimizing the "shock" of the semen, with resultant loss of spermatozoa activity, the thawing of the semen is carried out rapidly, but without subjecting the same to undesirably high temperatures, which would also result in weakening or killing sperm cells. Heretofore, thawing of such capsules of semen commonly has been carried out by one of two procedures, namely (1) "air thawing," or (2) placing the capsules in a vacuum bottle, or the like, containing warm water. Both such procedures have undesirable features.

"Air thawing," as the term implies, primarily consists of permitting the capsule of semen to thaw at the temperature of the surrounding air at the location where the thawing is being carried out and is sometimes accompanied by rolling the capsule between the palms of the hands of the operator in an endeavor to speed the process. Such an operation, at best, is tedious, and, in addition, because of the slowness of the thawing operation, commonly results in a substantial amount of the aforementioned "shock" to the sperm cells. The undesirableness of this operation is most apparent when the temperature of the air is low, such as when the operation is being conducted out-of-doors during cold winter weather.

The use of vacuum bottles, or the like, on the other hand, while tending to carry out the thawing out process at a more desirable rate, if the water in the vacuum bottle is at the proper temperature, is also undesirable for several reasons such as, for example being difficult to control and maintain the temperature of the water in the vacuum bottle; such procedure requiring replacement of the water in the bottle as the water is cooled; and, being generally cumbersome, and the like.

It is an important object of the present invention to enable the disadvantages of the methods heretofore used in thawing capsules of semen, used in artificial insemination operations, to be overcome in a novel and expeditious manner.

Another object of the present invention is to enable such capsules of semen to be thawed quickly, in a novel and expeditious manner, at the most efficacious rate of thawing.

An object ancillary to the foregoing is to enable the rate of thawing of the semen to be readily and accurately controlled in a novel and expeditious manner.

A further object of the present invention is to enable the shock caused to semen by the thawing thereof to be minimized in a novel and expeditious manner.

Also, as in known in the art, after frozen semen has been thawed and warmed to a desired temperature, such as, for example, a temperature of 90° or 95°F, if it is again subjected to a relatively low temperature, such as, for example, cold, outdoor winter temperatures, the sperm cells are again subjected to shock which may weaken or kill a substantial percentage of them. This, which is sometimes referred to as "shocking back," most commonly occurs when capsules of thawed, warm semen are placed in "guns" or other devices, for use in injecting the semen into the cervix of an animal to be impregnated, when the operation is being carried on out-of-doors in cold weather, and the gun, or the like, into which the capsule is inserted, is at the outdoor temperature. It is an important object of the present invention to prevent such "shocking back" of sperm cells to be caused.

Another object of the present invention is to enable such guns and devices to be preheated in a novel and expeditious manner to a desired temperature.

Yet another object is to enable such guns and devices to be stored in a novel and expeditious manner at such a desired temperature.

A further object of the present invention is to enable both capsules of semen and the devices in which they are to be used in insemination operations to be stored in a novel and expeditious manner, at selected, desired temperatures.

Another object of the present invention is to afford a novel unit for thawing, warming and storing semen, and which may be effectively used for maintaining the semen at the proper temperature both indoors and out-of-doors, whether the outdoor temperature is warm of cold.

Another object of the present invention is to afford a novel electrically heated warming and storage unit for the thawing, warming and storing of semen used in artificial insemination operations.

An object ancillary to the foregoing is to afford a novel electrically heated unit of the aforementioned type, which may be effectively used for prolonged periods of time while it is disconnected from any source of electric power.

Another object of the present invention is to affored a novel warming and storage unit of the aforementioned type which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

A warming and storage unit 1 embodying the principles of the present invention, is shown in the accompanying drawings to illustrate the presently preferred embodiment of the present invention.

Figure 3:
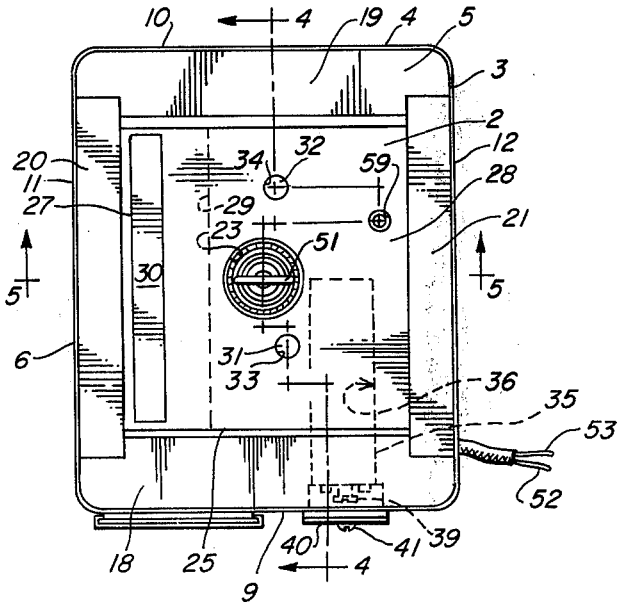
FIG. 3 is a top plan view of the unit shown in FIG. 1, with the cover and top insulation removed, looking in the direction of the arrows 3—3 in FIG. 1.
Figure 4:
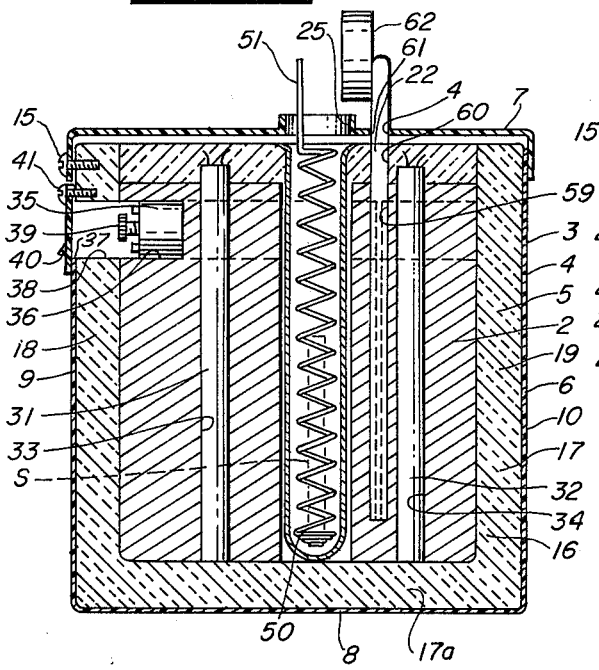
FIG. 4 is a vertical sectional view through the unit shown in FIG. 1, taken substantially along the line 4—4 in FIG. 3.
Figure 5:
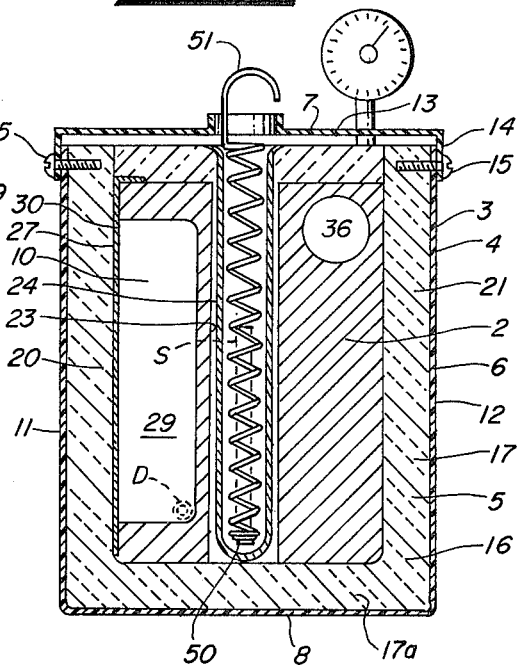
FIG. 5 is a vertical sectional view through the unit shown in FIG. 1, taken substantially along the line 5—5 in FIG. 3.

The unit 1 embodies, in general, a metal block 2 mounted in a housing 3, FIGS. 3–5, the housing 3 embodying an outer casing 4 and insulation 5, the insulation 5 lining the interior of the casing 4, and both the casing 4 and the insulation 5 being disposed around the block 2 in substantially surrounding relation thereto.

The block 2 may be made of any suitable heat-conducting material, such as, for example, metal or clay or other suitable ceramic material, but preferably is made of a metal having good heat conducting characteristics, such as, for example, aluminum or copper.

The casing 4 may be made of any suitable material, but preferably is made of a material having poor heat-conducting characteristics, such as, for example, a suitable plastic material, such as high-impact polypropylene or polystyrene, or the like.

The insulation 5 may be made of any suitable material, having low heat-conducting characteristics, but preferably is made from a suitable plastic material, such as, for example, a suitable foamed resinous material such as foamed polyester, or the like.

Figure 1:
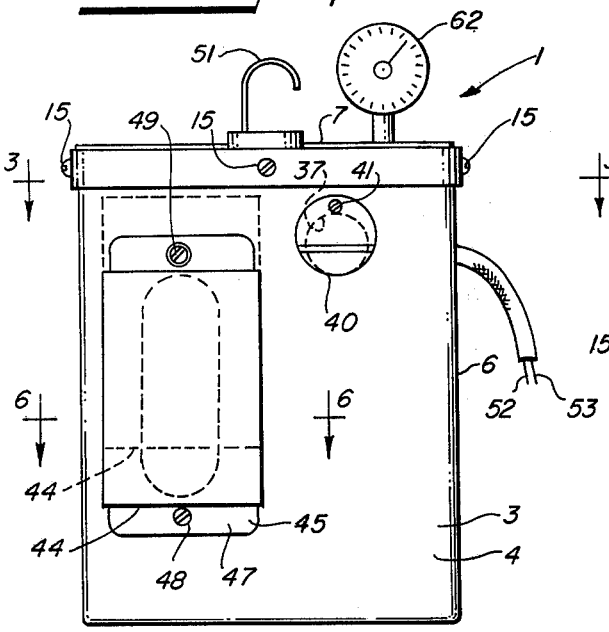
FIG. 1 is a front elevational view of a warming and storage unit embodying the principles of the present invention.
Figure 2:
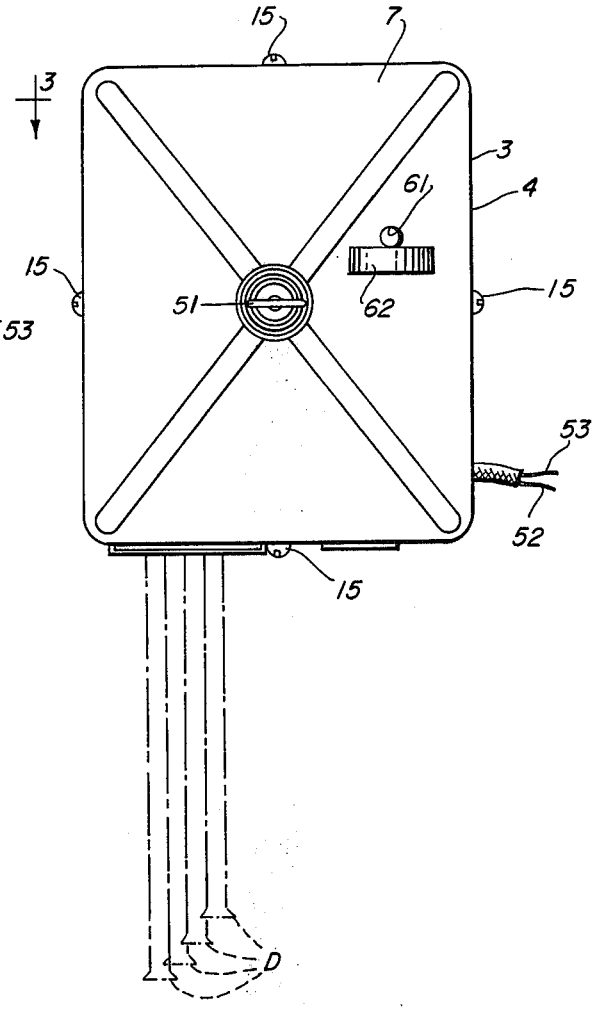
FIG. 2 is a top plan view of the warming and storage unit shown in FIG. 1.

The housing 3 is substantially rectangular in vertical and horizontal transverse cross section, FIGS. 1 and 2, and embodies an upwardly opening body portion 6 having a cover 7 mounted on the upper end thereof. The body portion 6 embodies a bottom wall 8, having a front wall 9, a rear wall 10 and two oppositely disposed side walls 11 and 12 projecting upwardly from respective side edges thereof, FIGS. 3–5. The cover 7 embodies a top wall 13 and a downwardly projecting peripheral flange 14, and, in the assembled unit 1, is mounted on top of the housing 3 with the flange 14 disposed around the upper end portion of the body portion 6 with a relatively snug, but freely slidable fit. The cover 7 is removable secured to the upper end portion of the body portion 6 by suitable means such as screws or bolts 15.

The insulation 5 is in the form of a hollow shell 16, FIGS. 4 and 5, in which the block 2 is disposed in the assembled unit 1. The shell embodies a body portion 17 which has a bottom wall 172 extending across and resting on the bottom wall 8 of the casing 4. The body portion 17 also embodies a front wall 18, a rear wall 19 and two oppositely disposed side walls 20 and 21 projecting upwardly from respective sides of the bottom wall 172 and disposed in snugly fitting relation to the walls 9–12, respectively, of the casing 4. The shell 16 also embodies a top wall 22, which is mounted in the upper end portion of the body portion 17 with a relatively snug, but freely slidable fit. In the assembled unit 1, the top wall 22 of the shell 16 rests on top of the block 2 in closely underlying relation to the cover 7 of the casing 4.

The block 2 has an upwardly opening compartment or well 23 extending therethrough along the vertical center line thereof, FIGS. 3–5. The compartment 3 preferably is substantially round in transverse cross section, and an elongated, open-topped container 24 is removably mounted therein and rests on the bottom wall 172 of the shell 16. The container 24 is of such length that, in the assembled unit 1, it projects upwardly through the top wall 22 of the insulating shell 16 and terminates at its upper end in uniplanar relation to the top face of the latter. An opening 25 is afforded in the top wall 13 of the cover 7 in position to overlie the compartment 23 and the container 24 in the assembled unit 1, FIGS. 4 and 5, for a purpose which will be discussed in greater detail presently.

The block 2, in the assembled unit 1, rests on the bottom wall 172 of the insulation shell 16, FIGS. 4 and 5, and embodies a front side 25, a rear side 26 and two oppositely disposed lateral sides 27 and 28, FIG. 3, which are disposed in engagement with the inner faces of the walls 18–21, respectively, of the shell 16 with a relatively snug, but freely slidable fit.

The block 2 also embodies an elongated compartment 29, FIGS. 3 and 5, which extends therethrough between the front side 25 and the rear side 26 thereof. The compartment 29 is substantially rectangular in transverse cross section, and is disposed in laterally outwardly spaced relation to the compartment 23. It is disposed immediately adjacent to the side 27 of the block 2, and is closed at that side by a removable plate 30, which, preferably, is made from the same metal as the remainder of the block 2.

Two elongated, vertically extending, electrically energizable heater elements 31 and 32 are disposed in openings 33 and 34, respectively, extending through the block 2, FIGS. 3 and 4. The heater elements 31 and 32 are disposed in forwardly and rearwardly spaced relation, respectively, to the compartment 23 and rest on the lower wall 172 of the insulating shell 16.

An elongated, thermostatically controlled or heat-sensitive switch 35 is mounted in an opening 36 formed in the block 2, the opening 36 extending horizontally rearwardly from the front side 25 of the block 2, in laterally spaced relation to the compartment 23, FIGS. 3 and 4. Aligned openings 37 and 38, FIGS. 1 and 4, are formed in the front wall 9 of the casing 4 and the front wall 18 of the insulating shell 16, respectively, in alignment with the opening 36 for affording access to the switch 35 from outside the casing 4 for adjusting the switch 35 such as, for example, by turning and adjusting screw 39, FIG. 4. In the preferred form of the unit 1, a cover plate 40 is rotatably mounted on the outer face of the front wall 9 of the casing 4 by suitable means such as a screw or bolt 41 for swinging movement around the latter into and out of covering relation to the openings 37 and 38.

Aligned openings 42 and 43 are formed in the front wall 9 of the casing 4 and the front wall 18 of the insulating shell 16, respectively, in alignment with the front end of the compartment 29 in the block 2. A closure panel or door 44 is slidably mounted on an adapter 45, mounted in the openings 42 and 43, for vertical sliding movement between a lowered closed position shown in solid lines in FIG. 1, and a raised open position shown in broken lines in FIG. 1, for a purpose which will be discussed in greater detail presently.

Figure 6:
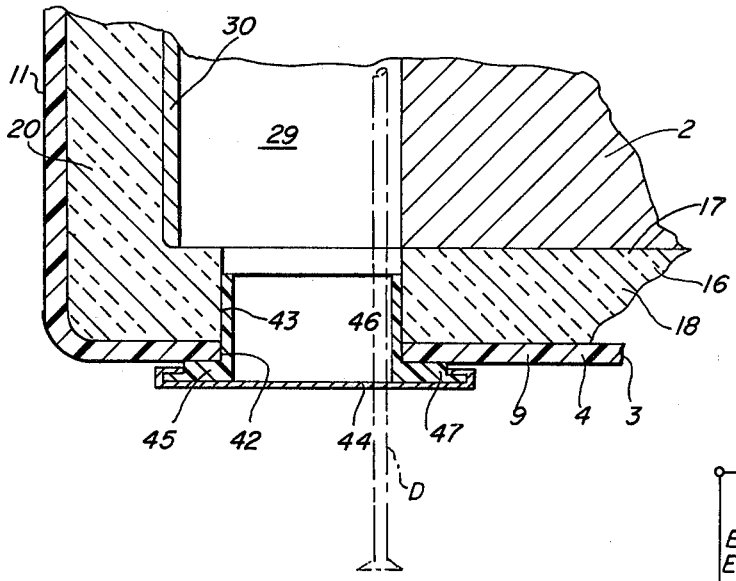
FIG. 6 is a fragmentary detail sectional view taken substantially along the line 6—6 in FIG. 1.

The adapter 45 has a tubular body portion 46, with a flange 47 projecting laterally outwardly from one side of the latter, FIG. 6. The body portion 46 is of the same transverse cross sectional size and shape as the openings 42 and 43 and is disposed therein with a relatively snug, frictional fit. In the assembled unit 1, the flange 45 is disposed in abutting engagement with the front face of the wall 9 of the casing 4, and is secured thereto by two screws 48 and 49. The door 44 is slidably mounted on the flange 47 for vertical sliding movement therealong between the aforementioned lowered position, shown in solid lines in FIG. 1, wherein it rests on the screw 48, the head of which projects outwardly from the flange 47, and the aforementioned raised position shown in broken lines in FIG. 1, the screw 49 being countersunk into the flange 47.

In the preferred form of the unit 1, an elongated open-sided basket 50, made of suitable material, such as, for example, spirally wound wire, and having a handle 51 at the upper end thereof, is removably mounted in the container 24. Preferably, the basket 50 is of such length that when it is disposed in the container 24 in position to reat on the bottom thereof, the handle 51 projects upwardly through the opening 25 in the cover 7 of the housing 3, FIGS. 4 and 5. With this construction, the basket 50 may be readily inserted into and withdrawn from the container 24 through the opening 25 in the housing 3.

Figure 7:
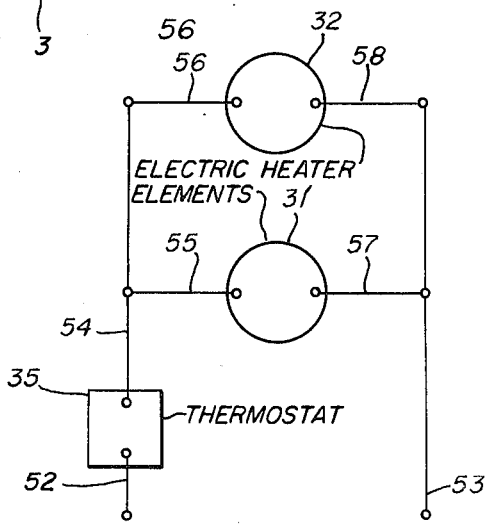
FIG. 7 is a wiring diagram illustrating the electrical circuitry embodied in the warming and storage unit shown in FIG. 1.

Two lead wires 52 and 53 extend into the housing 3, FIGS. 1–3. As diagrammatically shown in FIG. 7, one of the lead wires 52 is connected to one side of the switch 35, from the other side of which a wire 54 extends, which is connected, in parallel, by wires 55 and 56 to one side of the heater elements, 31 and 33, respectively; and, the other lead wire 53 is connected, in parallel, by wires 57 and 58 to the other sides of the heater elements 31 and 33, respectively. The wires 52–58 extend through suitable openings, not shown, in the casing 4 and the insulating shell 16. The end portions of the lead wires 52 and 53, remote from the heater elements 31 and 33, which extend outwardly of the housing 3 may be operatively connected to any suitable source of electric power for energizing the heater elements 31 and 32, and thereby heating the block 2.

In the preferred form of the unit 1, a vertically extending, upwardly opening thermometer well 59 is afforded in the block 2, with openings 60 and 61 extending through the insulating shell 16 and the casing 4, respectively, in vertically aligned relation thereto, for insertion of a suitable thermometer 62 into the housing 3 and the block 2 so that the temperature of the block 2 may be readily ascertained from outside the housing 3.

Preferably, in the storage unit 1, the electrical system thereof is such that it may be operated directly from the usual electric power source of an automobile, truck or farm tractor, or the like, such as, for example, the usual 12 or 24 volt battery systems thereof. With this construction, the operator is assured that he can energize the unit 1 from a source of electric power which can be expected to be available at the site of operation. On the other hand, with this construction, if electric power is available from a house or barn circuit, the unit 1, if desired, may be operated therefrom by connecting the lead lines 52 and 53 to the aforementioned circuit, through a suitable device such as a transformer, or the like, not shown, as will be readily appreciated by those skilled in the art.

The block 2 of the insulated warming and storage unit 1 is of sufficient mass, such as, for example, in the nature of 3 ½ pounds, that once it has been heated to the desired temperature, such as, for example, the temperature of 90° to 95°F, the block will remain at substantially the same temperature for a prolonged period of time even when the unit 1 is disconnected from the source of electric power and is exposed to substantially colder external temperatures, such as, for example, cold winter temperatures. Even with the block 2 having sufficent mass that it weighs 3 ½ pounds, the size of the unit 1 may be relatively small, such as, for example, of such a size that the housing 3 is 6 ½ inches in height and length and 5 ½ inches in width.

In the operation of the unit 1, the container 24, which preferably has a diameter in the nature of 1 inch, may be filled with water to a height greater than the length of the containers of semen to be thawed, such as, for example, to a height in the nature of 3 to 3 ½ inches. The lead wires 52 and 53 may then be connected to one of the aforementioned suitable sources of electric power and the block 2 may be heated to the aforementioned desired temperature, such as, for example, a temperature of 90° to 95°F. The temperature of the block 2 may be determined by reading the thermometer 62, and may be adjusted by suitably adjusting the switch 35 by turning the adjusting knob or screw 39 thereof to the proper setting. It has been found that warming and storage units 1 having the construction of the unit 1 and of the aforementioned size, normally will warm to a temperature of 90° to 95°F within 20 to 30 minutes, depending primarily upon the initial temperature of the block 2.

The apparatus or device by which the semen in the capsules is to be injected into the animal to be impregnated, may be of any suitable type, such as, for example, the device shown in U.S. Pat. No. 3,805,784, issued to Richard R. Alter on Apr. 23, 1974, such devices commonly being referred to in the art as "guns." Normally, while the unit 1 is warming to the desired temperature, the door 4 is maintained in closed position. After the desired temperature of the unit 1 has been attained, the door 4 may be slid upwardly into an open position, such as that shown in broken lines in FIG. 1, and the ends of the aforementioned devices, which are to be inserted into the animal, may be inserted into the compartment 29 through the opening 46 in the adapter 45, beneath the open door 44, as somewhat diagramatically indicated at D, in FIG. 2. At the same time, one or more of the capsules of semen to be used in a particular artificial insemination operation, such as a straw S indicated in FIG. 4, may be dropped through the opening 25 in the housing 3 into the basket 50, the liquid level in the container 24 preferably being such that the capsules are entirely covered thereby. In such an operation, the capsules of semen are thawed and warmed to the desired temperature in what may be considered to be a very short time. For example, when the capsules are in the form of the aforementioned "straws" commonly used for such purposes, and have been stored in a liquid nitrogen refrigerant, if the temperature of the water in the container 24 is between 90° and 95°F, the semen, normally, is thawed and heated to the same temperature as the liquid in 15 to 30 seconds. Thereafter, if desired, the individual capsules may be left in the container 24 where they will be retained at the aforementioned desired temperature, until it is desired to use one of the capsules in an insemination operation. Using this procedure, the individual capsule may then be removed from the unit 1 by raising the basket 50 by the handle 51, and removing the capsule from the basket 50. The capsule may then be inserted into one of the devices D, which has previously been preheated in the compartment 29, and using the device D, the insemination operation may be effected in a manner which is well known to those skilled in the art.

On the other hand, under certain circumstances, such as, for example, when it is desired to impregnate several animals one after another in a relatively short period of time, it may be desired to remove a plurality of the straws, such as, the aforementioned straw S, from the container 24, one at a time, inserting each straw into one of the devices D as it is thus withdrawn, and again disposing the device D in store position in the compartment 29. This will maintain the temperature of the straws and the temperature of the end portions of the devices D which are to be inserted into the animal, at the desired temperature so as to protect the straws from the aforementioned "shocking back" even when the insemination operation is being conducted out-of-doors in cold, winter weather.

From the foregoing it will be seen that the present invention affords a novel warming and storage unit.

Also, it will be seen that the present invention affords a novel warming and storage unit which is particularly well adapted for use in thawing, warming and storing insemination materials to be used in an artificial insemination operation.

In addition, it will be seen that the present invention affords a novel warming and storage unit of the aforementioned type which is practical and efficient in operation and which may be readily and economically produced commercially.

Thus, while I have illustrated and described the preferred embodiment of my invention, it is to be understood that this is capable of variation and modification, and I, therefore, do not wish to be limited to the precise details set forth, but desire to avail myself of such changes and alterations as fall within the purview of the following claims.

I claim:

1. A warming and storage unit for warming and thawing containers of frozen semen and storing such warmed and thawed containers of semen in guns used in the injection of such semen into an animal in artificial insemination operations, said unit comprising a. a housing of heat-insulating material, b. a metal block mounted in said housing, c. said block having 1. an upwardly opening compartment therein for removably receiving such a container of frozen semen to be warmed and thawed, and 2. another outwardly opening compartment of such size as to removably receive at least one such a gun to be stored.

d. said housing having openings therethrough in communication with respective ones of said compartments for affording access to the latter from outside said housing, and e. means for controllably heating said block to a predetermined temperature;

f. said means for heating comprising 1. electrically energized heater means mounted in said block in spaced relation to said compartments, and 2. means for connecting said heater means to a source of electric power, and g. said means for connecting including a heat-sensitive switch attached to said block.

h. said first mentioned compartment 1. being elongated, 2. extending substantially vertically, and 3. being substantially centered in said block and i. said other compartment 1. extending substantially horizontally and opening outwardly through one side of said block, and 2. being disposed in spaced relation to said first mentioned compartment, and j. said opening which is in communication with said other compartment being disposed in said housing in overlying relation to said one side of said block.

2. A warming and storage unit for containers of semen, said unit comprising a. a metal block having 1. an elongated, substantially upright well opening upwardly through the top of said block, and 2. a compartment a. disposed in spaced relation to said well, and b. opening outwardly, through, a peripheral surface, of said block, said compartment being of a size as to accommodate at least one insemination gun, b. a housing 1. comprising heat-insulation material, and 2. disposed around said block in substantially surrounding relation thereto, c. a basket for supporting such containers therein in said well, d. said housing having 1. an opening in the top thereof in overlying relation to said well in such position that said basket with such a container therein may be moved therethrough into and out of said well, and 2. another opening in a surface thereof and disposed in aligned relation to said compartment in such position that an insemination gun containing such a container of semen may be moved through said other opening and through said peripheral surface of said block into and out of stored position in said compartment, e. spaced electrically energized heater elements disposed on opposite sides of said well and disposed in spaced relation to said well and to said compartment, and f. means for operatively connecting said heater elements to a source of electric power, g. said means including a heat-sensitive switch 1. mounted in said block in spaced relation to said well and to said compartment, and
2. operatively connected to said heater element for controlling the temperature of said block.

3. A warming and storage unit as defined in claim 2, and in which a. said well is substantially cylindrical-shaped, b. said compartment has 1. two ends opening outwardly through respective opposite sides of said block, and
2. a removable sidewall extending between said two ends and defining another side of said block, and c. said housing includes a door for opening and closing said other opening.

4. A warming and storage unit as defined in claim 2, and in which a. said block has another well therein for removably receiving a thermometer therein, b. said other well is disposed in spaced relation to said first mentioned well, said compartment, said heater elements and said switch, and c. said housing has a third opening therein disposed in alignment with said other well in such position that such a thermometer may be moved therethrough into and out of said other well.

* * * * *